US005236373A

United States Patent [19]

Kennedy

[11] Patent Number: 5,236,373

[45] Date of Patent: Aug. 17, 1993

[54] CONNECTOR POSITION ASSURANCE ASSEMBLY

[75] Inventor: Robert D. Kennedy, Northville, Mich.

[73] Assignee: Interlock Corporation, Westland, Mich.

[21] Appl. No.: 913,164

[22] Filed: Jul. 14, 1992

[51] Int. Cl.[5] ..... H01R 4/50

[52] U.S. Cl. ..... 439/347; 439/352

[58] Field of Search ..... 439/345, 350, 488, 352, 439/357, 358, 347, 489

[56] References Cited

U.S. PATENT DOCUMENTS

| | | | |
|---|---|---|---|
| 4,746,306 | 5/1988 | Yurtin et al. | 439/352 X |
| 4,993,967 | 2/1991 | Matsumoto | 439/352 X |
| 5,026,298 | 6/1991 | Brussalis et al. | 439/352 X |
| 5,127,847 | 7/1992 | Kato et al. | 439/357 X |

*Primary Examiner*—Larry I. Schwartz
*Assistant Examiner*—Khiem Nguyen
*Attorney, Agent, or Firm*—Harness, Dickey & Pierce

[57] ABSTRACT

A connector assembly for assuring proper engagement of mated electrical connectors. The assembly includes a pair of connectors which are configured for creating electrical contact between terminals housed therein. A position assurance member is retainingly engaged with one of the connectors in a preassembled position. If the connectors are properly engaged, the connection position assurance member is capable of being moved from its preassembled position to a second or home position. Upon improper engagement of the connectors, movement of the position assurance member from its preassembled position to its home position is prohibited thereby indicating that improper engagement between the connectors exists.

5 Claims, 2 Drawing Sheets

35
40
40
30
14
12
16
62
54
20
26
78
74
58
76
80
70
64
68
66
56
72
44
46
26

35
40
40
30
14
12
62
68
16
20
26
60
54
78
74
58
80
76
70
64
68
66
56
72
44
46
26

12
14
62
16
20
26
54
74
19
58
60
72
44
23
64
70
56
78
66
46
68
26

CONNECTOR POSITION ASSURANCE ASSEMBLY

BACKGROUND AND SUMMARY OF THE INVENTION

This invention relates generally to electrical connectors and more particularly to an assembly for assuring proper positioning and engagement of mated electrical connectors.

In developing electrical connector systems, it is desirable to incorporate features which, either visually or physically, assure that mated electrical connectors have been fully and properly engaged during the assembly procedures. These features have commonly become known as connector position assurance (CPA) members. In the end products with which they are used, the CPA members allow for increased production rates and greater quality control by more readily permitting inspection of the electrical connectors for proper connection. As used herein, the terms "fully and properly engaged" are intended to mean that the electrical terminals housed within the mated electrical connectors have been engaged with sufficient electrical contact between them to achieve their intended purpose.

Typically, the CPA members are manually inserted into the electrical connectors after the connectors have been assembled together. If the CPA member can be inserted into the assembled electrical connectors, it is an indication that the electrical connectors have been properly engaged. If the CPA member cannot be inserted into the assembled electrical connectors, it is an indication that the electrical connectors are not properly engaged.

One disadvantage is that these previous CPA members do not readily lend themselves to automated use. Since the prior CPA members required an operator to manually insert them into the assembled electrical connectors, the operator had to physically carry a supply of the CPA members when ascertaining whether or not the electrical connectors have been properly assembled.

In view of the above and other limitations, it is an object of the present invention to provide for an electrical connector assembly having a CPA member which cooperates with a pair of electrical connectors to assure that the electrical connectors have been fully and properly engaged together.

It is another object of this invention to provide for an assembly having a CPA member which will provide both physical and visual assurances that the electrical connectors have been fully and properly engaged together.

It is a further object of this invention to provide for an assembly having a CPA member which may be preassembled with one of the electrical connectors prior to the electrical connectors being engaged together. Once preassembled, inadvertent removal of the CPA member is prevented.

Still another object of this invention is to provide a connector position assurance assembly having a CPA member which, upon proper engagement of the pair of electrical connectors, may be moved from its preassembled position into a second or home position thereby indicating that the electrical connectors have been fully and properly assembled. If the pair of electrical connectors are improperly assembled, the CPA member will fixedly remain in its preassembled position as movement into the home position is inhibited.

In achieving the above objects, the present invention provides an electrical connector position assurance assembly in which a first electrical connector, is configured for mated connection with a second electrical connector. The CPA member is mounted in a first or preassembled position with a portion of the first electrical connector prior to the engagement of the first and second electrical connectors.

In its preassembled position, the CPA member is prevented from being inadvertently removed or moved into a second or home position. Only if the first and second electrical connectors have been properly assembled together can the CPA member be moved from its preassembled position into its home position.

Upon assembly of the connectors, a portion of the second electrical connector operates to disable a stop member, which has been prohibiting movement, and thereby permits movement of the CPA member into its home position indicating that the electrical connectors are properly and fully connected.

The CPA member utilized in the present invention is readily mounted into its preassembled position through automated assembly procedures. Furthermore, the assembling of the first and second electrical connectors can also be achieved by automated procedures. Additionally, movement of the CPA member from its preassembled position into its home position can be performed by appropriate mechanisms or can be performed by an operator manually actuating the CPA member to see if movement occurs.

If service of the electrical connectors is required, the deliberate removal of the CPA member and disconnecting of the electrical connectors is easily performed.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENT

Figure 1:
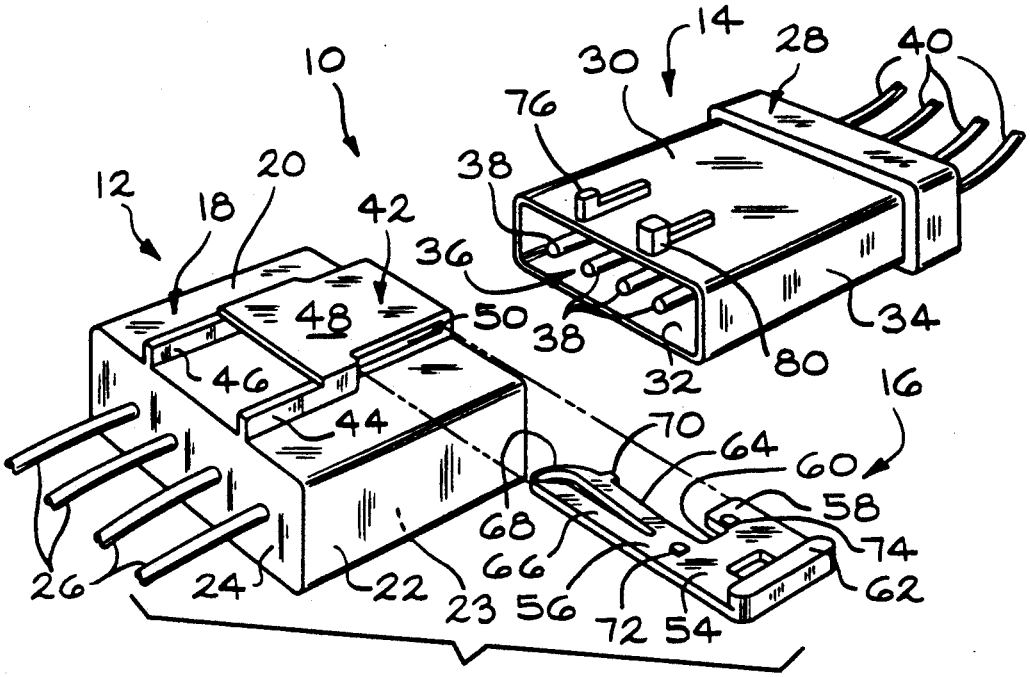
FIG. 1 is a perspective view of an unassembled connector position assurance assembly embodying the principles of the present invention.
Figure 2:
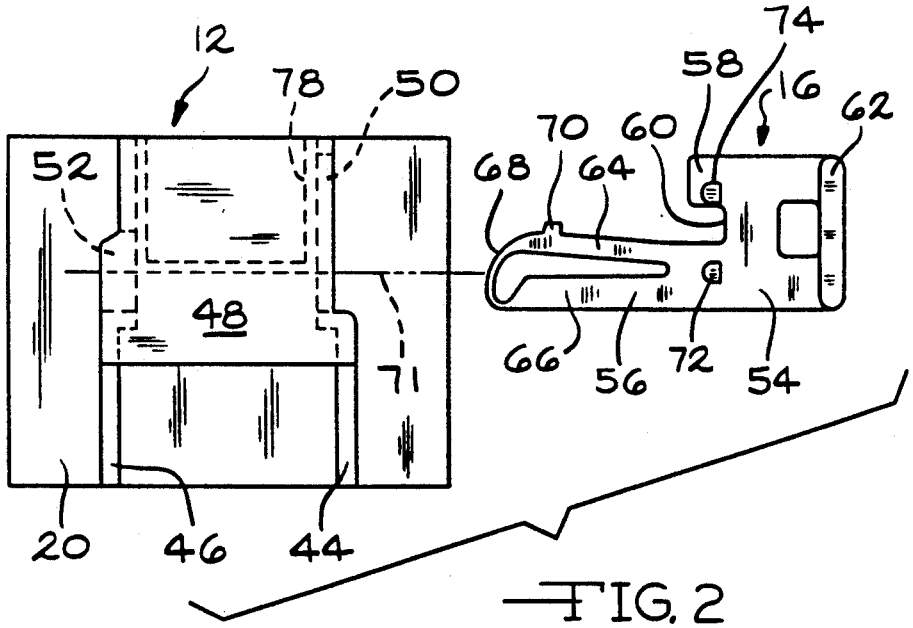
FIG. 2 is a plan view showing the insertion axis of the CPA member relative to one of the electrical connectors.

Now with reference to the drawing, a connector position assurance assembly embodying the principles of the present invention is generally illustrated in FIG. 1 and designated at 10. The primary components of the present assembly 10 include a pair of electrical connectors 12 and 14 and a connector position assurance (CPA) member 16.

The electrical connector 12 (hereinafter the female connector 12) includes a housing 18 which defines a cavity 19 for enclosing at least one, and preferably more than one electrical terminal (not shown). As such, the housing 18 of the female connector 12 includes a top wall 20, sidewalls 22, a bottom wall 23 and an end wall 24. The cavity 19 is open on an end opposite of the end wall 24. The terminals are secured within the housing 18 by conventional methods and leads 26, connected to the terminals, extend through the end wall 24 of the housing 18 to the component with which the female connector 12 is being used.

The mating electrical connector 14, hereinafter the male connector 14, likewise includes a housing 28 having a top wall 30, a bottom wall 32, sidewalls 34, and an end wall 35. Thus, the housing 28 of the male connector 14 also defines a cavity 36 which is open at one end 36 and which encloses electrical terminals 38. The terminals 38 are conventionally secured within the housing 28 and are connected to leads 40 that extend through the end wall 35 of the male connector 14.

As readily seen in FIG. 1, the female and male connectors 12 and 14 are configured for mated engagement with one another. Similarly, the terminals within the female connector 12 are configured to engage and make electrical contact with the terminals 38 of the male connector 14.

Formed on the top wall 20 of the female connector 12 is a raised receiver 42. The receiver 42 includes a pair of opposing walls 44 and 46 which extend upward from the top wall 20 of the housing 18. A transverse wall 48 extends between the upright walls 44 and 46. Formed in the upright walls 44 and 46, substantially opposite from one another, are first and second slots 50 and 52 into which the CPA member 16 is received. While other positioning is possible, it is preferred that the slots 50 and 52 are formed in the upright walls 44 and 46 generally adjacent to the open end of the female connector 12. As will be more fully appreciated from the discussion set out below, the first slot 50 is somewhat greater in its length than the second slot 52.

The CPA member 16 includes a main body portion 54 having primary and secondary extensions 56 and 58 which extend off to one side thereof. A recessed portion 60 is formed between the extensions 56 and 58. On the opposing side of the main body 54 is a transverse rib 62 which provides a gripping surface for the CPA member 16 when it is manually handled by an operator.

The primary extension 56 of the CPA member 16 includes a pair of diverging scissor-like legs, hereinafter upper and lower legs 64 and 66, which are connected together at their outermost ends by an integral resilient loop portion 68. While the illustrated embodiment is shown with the legs 64 and 66 connected together at their outermost ends, in an alternative embodiment the legs 64 and 66 could be separate and free without impacting the operability of the CPA member 16. The legs 64 and 66 are inherently formed so as to be resiliently biased apart. The loop portion 68 provides an additional means for biasing the legs 64 and 66 apart. As seen the figures, the width of the lower leg 66 is greater than that of the upper leg 64.

Formed outboard of the main body portion 54 on the upper leg 64, adjacent to the loop portion 68, is a stop tooth 70. The stop tooth 70 is formed so as to extend transversely off of the upper leg 64 in a direction away from the lower leg 66 and an insertion axis 71. Furthermore, the distance which the stop shoulder 70 extends from the upper leg 64, is less than the distance between the upper leg 64 and lower leg 66 immediately therebetween.

Figures 3, 4, 5:
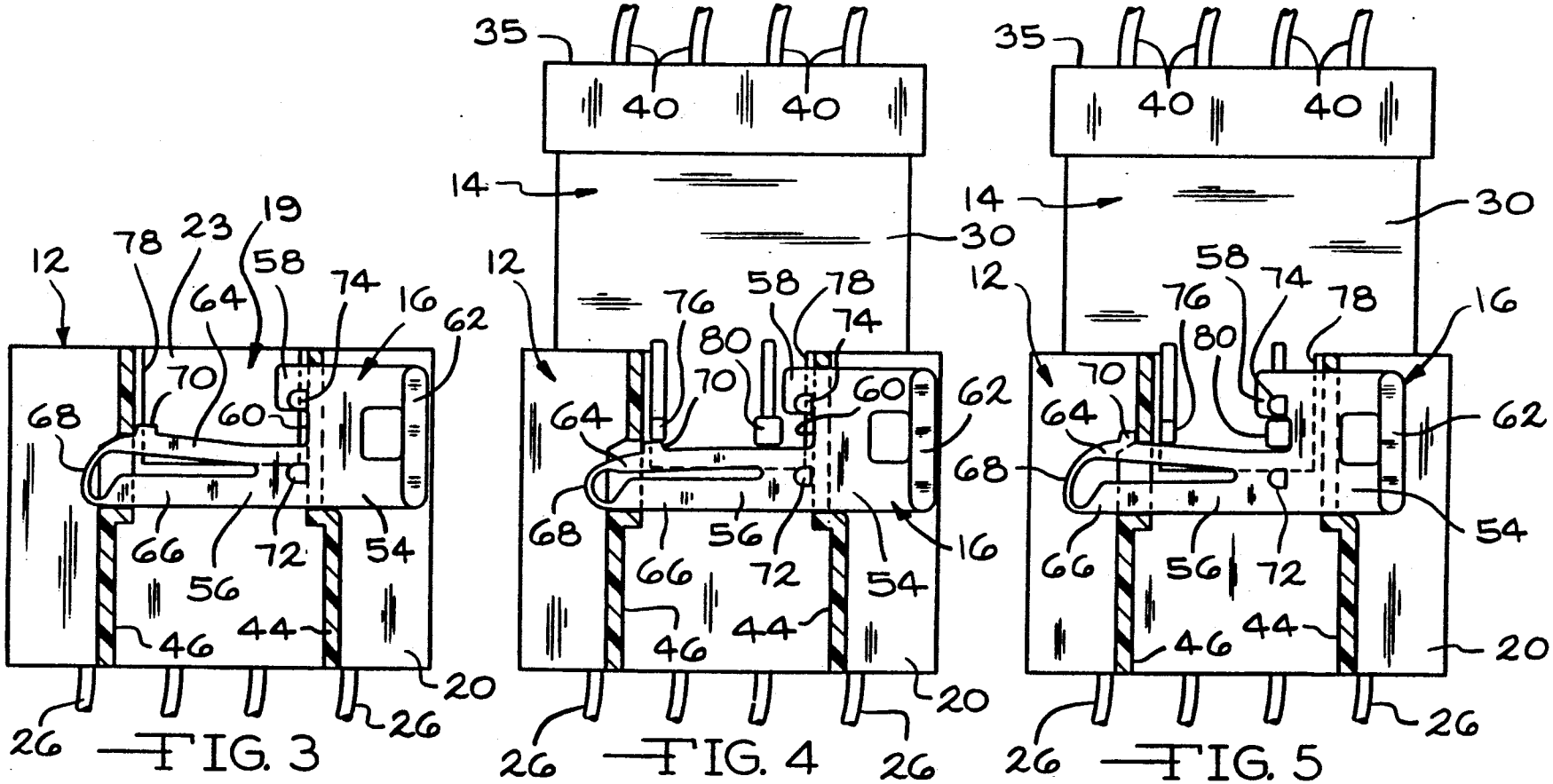
FIG. 3 is plan view with portions broken away showing the CPA member preassembled with one of the electrical connectors.
FIG. 4 is a plan view with portions broken away illustrating the electrical connectors being fully assembled together and the relative position of the CPA.
FIG. 5 is a plan view substantially similar to FIG. 3 illustrating the CPA member in its home position.

In mounting the CPA member 16 to the female connector 12, the loop portion 68 is directed along the insertion axis 71 into the first slot 50 and through the receiver 42 into the second slot 52. The length of the second slot 52 is dimensioned to substantially correspond with the width of the loop portion 68. The first slot 50 is dimensioned to correspond with and to receive the main body portion 54 of the CPA member 16. As seen in FIG. 3, when the CPA member 16 has been inserted into the receptacle 42, the stop shoulder 70 will engage a portion of the upright wall 46 and will prevent further insertion of the CPA member 16. This is the preassembled position of the CPA member 16.

A pair of shoulders or detents 72 and 74 extend upward from the primary body portion 54 to resist withdrawal of the CPA member 16. The detents 72 and 74 may include ramped upper surfaces to assist in their passage through the first slot 50. When inserted, the CPA member 16 is "locked" into its preassembly position. Thus, the CPA member 16 is prevented from being inadvertently withdrawn from the receptacle 4 by interfering engagement of the detents 72 and 74 with an interior portion of the wall 44 adjacent to the first slot 50. The CPA member 16 is prevented from being further inserted along the axis 71 into the receiver 42 by the interfering engagement of the stop tooth 70 with an interior portion of the wall 46 adjacent to the second slot 52. With the CPA member 16 securely held in its preassembled position, the female connector 12 can be readily manipulated for additional and subsequent assembly procedures without fear that the CPA member 16 will become dislodged and/or lost.

As mentioned above, the configuration of the male connector 14 allows for mated engagement with the female connector 12. If the connectors 12 and 14 are fully and properly mated, electrical contact will be made between the male terminals 38 and the terminals of the female connector 12.

As seen in FIG. 4, when the male connector 14 is fully and properly engaged with the female connector 12, a raised portion or cam 76 extending upward from the top wall 30 of the male connector will engage the stop tooth 70 and compress the upper leg 64 toward the lower leg 66. The lower leg 66 will not deflect because it is in contact with a portion of the wall 46 that defines the second slot 52. To permit the cam 76 to engage the stop tooth 70, a slot 78 is defined in the top wall 20 of the female connector 12. This slot 78 is positioned substantially beneath the transverse wall 48 of the receiver 42. When the male connector 14 is fully and properly engaged with the female connector 12, the upper leg 64 will be compressed toward the lower leg 66 by an amount sufficient to disengage the stop tooth 70 from the upright wall 46. Alternatively, the cam 76 could engage the upper leg 64 instead of the stop tooth 70.

Movement of the CPA member 16 into its home position is now permitted because, with the upper leg 64 deflected, the stop tooth 70 is able to pass through the slot 52. After the stop tooth 70 has passed through the slot 52, the upper and lower legs 64 and 66 return to their outwardly biased positions. Withdrawal of the CPA member 16 from the receiver 42 is now inhibited by interfering engagement between the stop tooth 70 and the exterior surface of the upright wall 46.

To prevent over insertion of the CPA member 16 through the receiver 42, a boss or raised projection 80 is also formed in the top wall 30 of the male connector 14. The positioning of the boss 80 on the top wall 30 is such that when the connectors 12 and 14 are properly engaged and the CPA member 16 is moved into its home position, the boss 80 is received in the recessed portion 60 of the CPA member 16 which obstructs further insertion.

If desired, the CPA member 16 may be removed and the electrical connectors 12 and 14 disconnected for servicing. This is easily done by manually compressing the upper and lower legs 64 and 66 together, thereby disengaging the stop tooth 70 and allowing for withdrawal of the CPA member 16.

The above description of the preferred embodiment is intended only to be illustrated of the various aspects of the present invention and is not intended to limit the invention to the precise form disclosed. Thus, it is understood that connector position assurance assemblies having CPA members which are mounted in a first preassembled position and movable to a second home position, upon the proper engagement of two electrical connectors, are believed to be within the purview of this invention.

While the above description constitutes the preferred embodiment of the present invention, it will be appreciated that the invention is susceptible to modification, variation, and change without departing from the proper scope and fair meaning of the accompanying claims.

What is claimed is:

1. A connector assembly for assuring proper engagement of a pair of mated electrical connectors, said assembly comprising:

a first electrical connector having a predetermined shape and including a housing having a top wall, a bottom wall, sidewalls and an end wall all cooperating to define a first cavity being open at one end, at least one electrical terminal being positioned within said first cavity;

a second electrical connector including a housing, said housing having a top wall, a bottom wall, side walls and an end wall all cooperating to define a second cavity being open at one end, at least one electrical terminal being positioned within said second cavity, said second electrical connector having a configuration substantially corresponding to said predetermined shape of said first electrical connector and permitting axial mated engagement of said first and second electrical connectors;

a position assurance member having a main body portion and a deflectable arm projecting therefrom, said position assurance member being engageable in first and second positions with said first electrical connector and being transversely movable with respect thereto from said first position into said second position;

means formed on said first electrical connector for receiving said position assurance member in said first and second positions;

a stop tooth formed on said deflectable arm, said stop tooth interferingly engaging a portion of said first electrical connector and preventing movement of said position assurance member from said first position into said second position; and disabling means formed on said second electrical connector for engaging said deflectable arm and disengaging said stop tooth from said portion of said first electrical connector and permitting transverse movement of said position assurance member from said first position to said second position, said disabling means operating in response to proper mated engagement of said first and second electrical connectors and establishment of electrical contact between said electrical terminals of said first and second electrical connectors.

2. A connector assembly as set forth in claim 1 further comprising means for inhibiting movement of said position assurance member out of said second position.

3. A connector assembly as set forth in claim 2 wherein said inhibiting means includes a projecting boss formed on said second connector, said boss positioned to interferingly engage said position assurance member and prevent movement of said position assurance member beyond said second position.

4. A connector assembly according to claim 1 wherein said disabling means includes a boss being formed on the second electrical connector, upon mated engagement of said first and second electrical connectors and establishment of electrical contact between said electrical terminals and said boss engaging said position assurance member and axially deflecting said deflectable arm to move said stop tooth out of interfering engagement with said portion of [receiving means] said first electrical connector permitting movement of said position assurance member from said first position to said second position, said position assurance member being retainingly engaged in said second position.

5. A connector assembly for assuring proper engagement of electrical connectors, said assembly comprising:

a first connector including a housing having at least one electrical terminal mounted therein, a second connector also including a housing and having at least one electrical terminal mounted therein, said first and second connectors being configured for engagement with one another and for establishing electrical contact between said electrical terminals;

a connector position assurance member movable into a preassembled position relative to said first connector prior to engagement of said first and second connectors, said member being movable from said preassembled position to a second position relative to said first connector upon proper engagement of said first and second connectors thereby assuring establishment of electrical contact between said electrical terminals, said member including a deflectable arm having a portion preventing movement of said member from said preassembled position into said second position, said member also including a second arm, said second arm being integrally formed with said deflectable arm at fist and second ends thereof, said deflectable arm and said second arm having portions cooperating to define an opening therebetween, said portions being deformable permitting said deflectable arm to deflect toward said second arm; and means for deflecting said deflectable arm toward said second arm and permitting movement of said member from said preassembled position into said second position, said deflecting means being operative only upon proper engagement of said first and second connectors.

* * * * *

UNITED STATES PATENT AND TRADEMARK OFFICE

CERTIFICATE OF CORRECTION

PATENT NO. : 5,236,373

DATED : August 17, 1993

INVENTOR(S) : Robert D. Kennedy

It is certified that error appears in the above-identified patent and that said Letters Patent is hereby corrected as shown below:

In Column 4, line 24, after "receptacle", delete "4" and insert --42--.

In Column 6, line 27, Claim 4, after "said portion of", delete "[receiving means]".

In Column 6, line 55, Claim 5, after "arm at" delete "fist", and insert --first--.

Signed and Sealed this

Twenty-sixth Day of April, 1994

Bruce Lehman

*Attest:*

BRUCE LEHMAN

*Attesting Officer*

*Commissioner of Patents and Trademarks*